United States Patent [19]

Murayama

[11] Patent Number: 4,693,046

[45] Date of Patent: Sep. 15, 1987

[54] METHOD OF CONSTRUCTING FLOOR FOR BUILDINGS OR SIMILAR STRUCTURES

[76] Inventor: Yoshihiro Murayama, Hongo House 1105, 27-8, Hongo-1-chome, Bunkyo-ku, Tokyo, Japan

[21] Appl. No.: 733,329

[22] Filed: May 13, 1985

[51] Int. Cl.[4] ..... E04B 5/19

[52] U.S. Cl. ..... 52/520; 52/444; 52/741

[58] Field of Search ..... 52/319, 320, 321, 322, 52/323, 324, 378, 444, 325, 741, 747

[56] References Cited

U.S. PATENT DOCUMENTS

| | | | |
|---|---|---|---|
| 178,988 | 6/1876 | Borie | 52/444 |
| 940,227 | 11/1904 | Benas | 52/444 |
| 1,074,760 | 10/1913 | Vought | 52/324 |
| 1,229,904 | 6/1917 | Day | 52/321 |
| 1,316,136 | 9/1919 | Bevier | 52/324 |
| 1,646,183 | 10/1927 | Bevier | 52/320 |
| 1,884,462 | 10/1932 | Willson | 52/608 |
| 2,033,751 | 3/1936 | Yeager | 52/322 |
| 2,328,453 | 8/1943 | Hopewell | 52/321 |

*Primary Examiner*—John E. Murtagh

*Attorney, Agent, or Firm*—Fuller, Puerner & Hohenfeldt

[57] ABSTRACT

A method of constructing a floor for concrete buildings or similar structures is disclosed, wherein a precast reinforced concrete slab is placed on and between at least two steel or concrete beams or girders and then a ready mixed concrete is poured as cast-in-place concrete and cured thereon to form the floor intergal with said precast concrete slab.

3 Claims, 10 Drawing Figures

Load-Deflection Curve on Composite Slab

METHOD OF CONSTRUCTING FLOOR FOR BUILDINGS OR SIMILAR STRUCTURES

BACKGROUND OF THE INVENTION

1. Field of the Invention

The present invention relates to concrete floors for buildings or similar structures which utilize at least one precast reinforced concrete slab as a basic structural element.

2. Description of the Prior Art

In a conventional method of constructing a floor for buildings or similar structures which utilizes precast reinforced concrete slabs, one or more such slabs are placed on a supporting structure, which may be two or more steel or concrete beams or girders, to form a basic floor structure. Reinforcing steel bars are placed under tension above the slab, a ready mixed concrete is poured in-situ on the slab to embed the reinforcing steel bars, and the poured concrete or so-called cast-in-place concrete is cured to form a floor structure composite with said precast slab.

It is known that, in general, the strength of a floor of a predetermined concrete material is in proportion to the square of the thickness in the floor.

In a floor formed according to said conventional methods, the strength thereof can be calculated based on the total thickness of the floor if the slab is made composite with the cast-in-place concrete. If the cast-in-place concrete does not act compositely with the precast reinforced concrete slab, the strength is calculated using the thickness of the slab and the subsequently formed concrete layer individually.

It can be seen from experience that more pouring and curing of the ready mixed concrete in-situ on the precast concrete slab does not provide sufficient composite action therebetween. This means the thickness of the precast slab or the cast-in-place concrete layer must be increased to achieve the same strength as the composite slab, but this has the disadvantage of increasing the floor weight.

In order to resolve such a problem, another type of precast reinforced concrete slab and an apparatus for manufacturing the same have been proposed as disclosed in U.S. Pat. No. 3,426,403, wherein at least one lattice girder is arranged in position in a mold, if necessary together with reinforcing steel bars. Ready mixed concrete is poured in the mold and cured to form a solidified concrete slab having a projection which is a part of said lattice girder. The lattice serves as an anchor when this concrete slab is placed in position and ready mixed concrete is poured and cured thereon to construct a floor structure. An apparatus for manufacturing a lattice girder different from that shown in said U.S. Pat. No. 3,426,403 has been disclosed in U.S. Pat. No. 3,198,219.

Such a precast reinforced concrete slab is called "Omnia Slab" or "Kaiser Plate" and is employed widely as a base element to be used compositely with cast-in-place concrete to form a so-called composite floor structure for concrete buildings or similar structures. The slab has such disadvantages, due to its structure having part of the lattice girder project from the reinforced concrete slab, as continuous molding cannot be carried out, a higher manufacturing cost, and careful handling is required in storage, transportation, and installation to reduce workability, since the projecting lattice girder tends to deform due to impact or like external causes.

SUMMARY OF THE INVENTION

The present invention provides a method of constructing a floor for buildings or similar structures, which utilizes a basic structural element a precast reinforced concrete slab which is easily molded at a reasonable cost, can easily be handled without any special care or any additional steps and provides reliable composite action between the precast slab and cast-in-place concrete to attain a desired strength in the resulting floor structure equivalent to a one-piece floor structure formed using molding frames and timbers.

According to the invention, the method comprises the steps of placing on a supporting structure a precast reinforced concrete slab having a number of cavities in a surface, arranging reinforcing steel bars above the concrete slab, pouring a ready mixed concrete as cast-in-place concrete on the concrete slab to embed the reinforcing steel bars, and curing the ready mixed concrete to form a composite floor structure of the precast concrete slab and the cast-in-place concrete layer.

In a floor constructed by the method according to the invention, the cavities formed in the precast concrete slab serve not only for increasing the contact or binding area of the slab with the cast-in-place concrete, but also for providing a space to receive shear members formed in the cast-in-place concrete. It is preferable that the concrete slab have five hundred or more cavities per square meter, each having a diameter and depth of about 25 and 5 mm respectively.

DETAILED DESCRIPTION OF THE INVENTION

Two types of precast reinforced concrete slabs to be employed with the method of the invention will be explained with reference to FIGS. 1 to 3.

Figure 1:
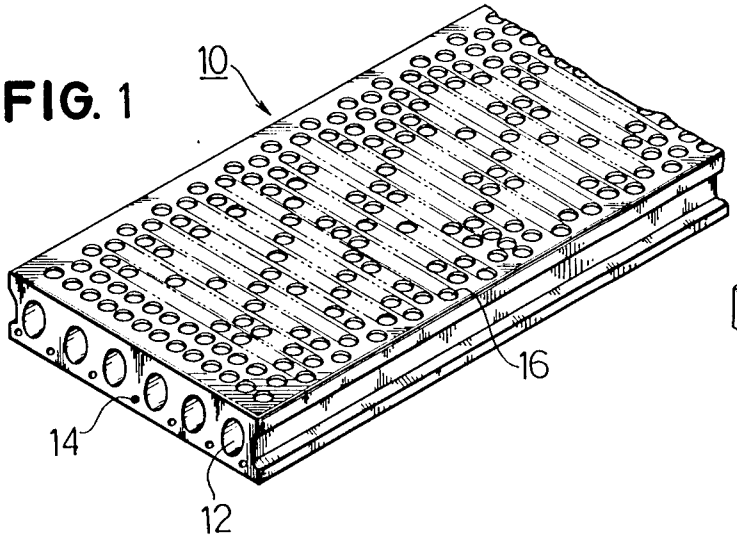
FIG. 1 is a partial perspective view of a precast reinforced concrete slab to be employed with the method according to the invention.
Figure 2:
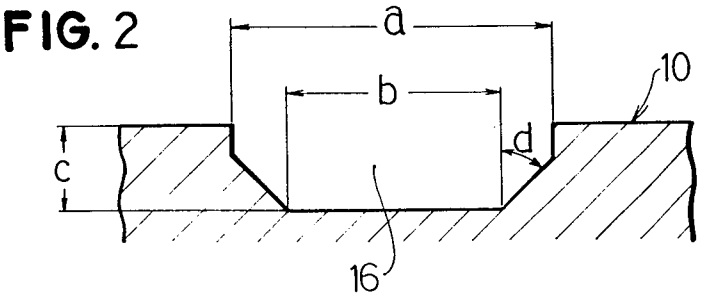
FIG. 2 is an enlarged partial section of the slab as shown in FIG. 1, showing a configuration or contour of a cavity formed therein.

FIG. 1 shows the first type of precast reinforced concrete slab 10 which has a number of bores 12 arranged in the longitudinal direction of the slab 10 and extending across the width of the slab, and has a plurality of steel or iron bars 14 embedded under tension in the slab 10 to strengthen the same.

On an upper surface of the slab 10 there are formed a large number of cavities 16. Each of the cavities 16 may have a circular configuration in horizontal section and a vertical contour as shown in FIG. 2. Each cavity 16 has a size, for instance, that of diameter a at the open edge is 25 mm, bottom diameter b 17 mm, height c 5 mm, and the angle d 45 degrees, but the configuration and size may, of course, be modified.

Figure 3:
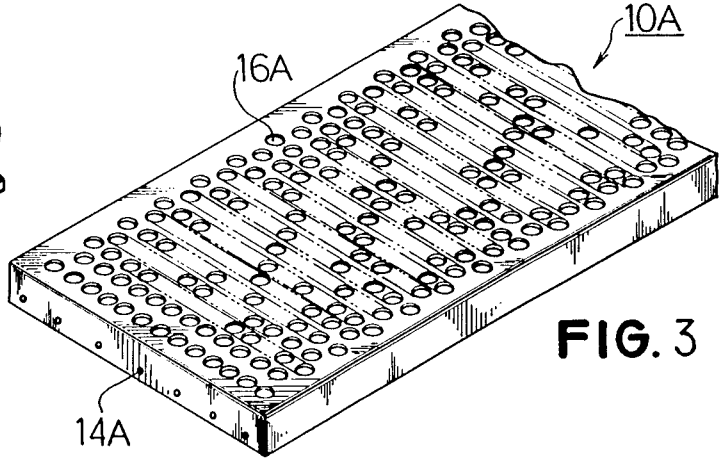
FIG. 3 is a partial perspective view of another precast concrete slab to be employed with the method of the invention.

FIG. 3 shows a second type of precast reinforced concrete slab 10A which is different from the slab 10 as shown in FIG. 1 only in that this slab 10A has no bores and thus explanation thereof is omitted for the sake of simplicity.

Figure 4:
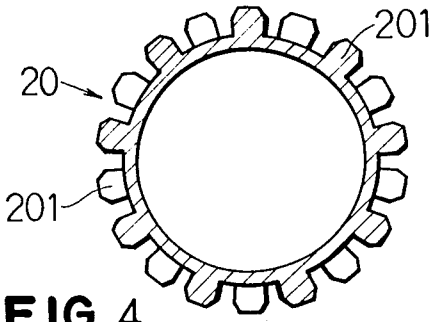
FIG. 4 is a vertical section of a drum for forming the cavities in the slab before curing thereof.

Slab 10 can be manufactured, for instance, in a manner as stated hereinafter. Above a flat mold, reinforcing steel bars are arranged under tension and ready mixed concrete is poured thereon to embed the reinforcing bars therein. Then a mold frame is moved to demold a formed slab and make an upper surface thereof flat. The resulting uncured slab is treated by a rotary drum 20 as shown in FIG. 4, which has a large number of projections 201 formed on its cylindrical outer surface to form the cavities 16 in the uncured slab. The uncured slab is left to stand for curing thereof and when the strength has reached a predetermined level, it is cut to obtain a complete reinforced concrete slab 10 of the desired length.

Figure 5:
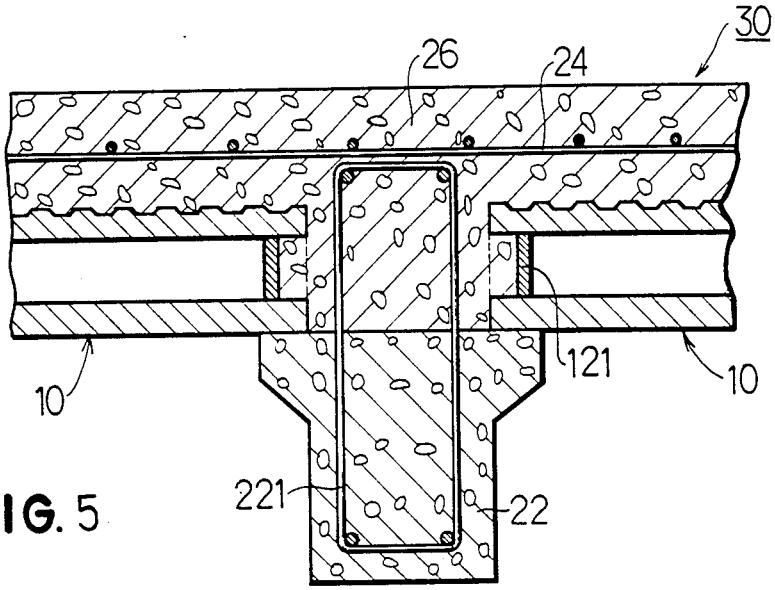
FIG. 5 is a vertical section of a floor structure constructed by the method according to the invention.
Figure 6:
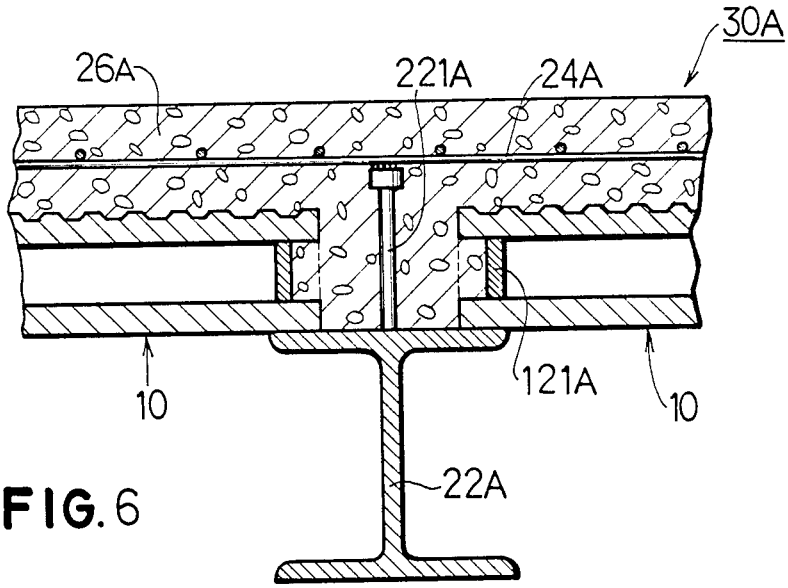
FIG. 6 is a vertical section of another floor structure constructed by the method according to the invention.

A method of constructing a composite floor structure using such precast reinforced concrete slab 10 will be explained with reference to FIGS. 5 and 6.

The ends of each slab 10 are placed on a beam or girder as a supporting structure. If the supporting structure is a concrete girder 22 as shown in FIG. 5, an end of each slab 10 is placed at each side of an anchoring steel bar 221 projecting from the upper surface of the girder 22. If the supporting structure is a steel girder 22A as shown in FIG. 6, a stud 221A is vertically mounted at a central portion of the steel girder 22A and then an end of each slab 10 is placed at each side of the stud 221A.

In the manner described above, a plurality of such precast slabs 10 are placed in position over an area to be made as a floor. Thereafter, the reinforcing steel bars 24 (24A) are assembled above the placed slabs 10 with the aid of a supporting member such as the anchoring steel bar 221 or stud 221A as shown in FIGS. 5 and 6. A ready mixed concrete is then poured in the space between the precast concrete slabs 10, as well as on the slabs 10 until the upper level of the cast-in-place concrete layer 26 (26A in FIG. 6) reaches a predetermined height. The cast-in-place concrete is left to stand for curing thereof to form a floor structure 30 (30A in FIG. 6) together with the slabs 10.

In the resulting floor structure 30 (30A), the precast slabs 10 integrally combine with the cast-in-place concrete layer 26 (26A), because the cast-in-place concrete fills the space between adjacent precast slabs 10 (the bores 12 formed therein (see FIG. 1) may be blocked with a barrier 121 (121A in FIG. 6) and the cavities 16 (16A in FIG. 3) formed in each slab 10 serve as shear members, so that the floor structure withstands as a one-piece body against a bending force due to a vertical load.

Therefore, a desired floor strength can be attained with a relatively thin floor structure according to the method of invention.

TEST EXAMPLE

Figure 7:
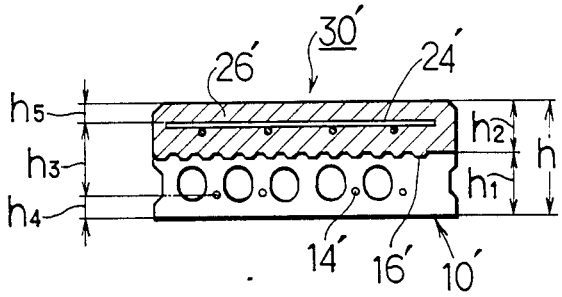
FIG. 7 is an end section of a composite floor test piece.

Test pieces of a composite floor structure 30' as shown in FIG. 7 were prepared in the following manner.

| | |
|---|---|
| A. Precast reinforced concrete slab 10' | |
| a. Composition of concrete material | |
| Portland cement | 420 (kg/m$^3$) |
| River sand | 1140 |
| Crushed stone (max. 7 mm) | 562 |
| Water | 155 |
| b. Reinforcing strands 14' | |
| 4-$\frac{3}{8}$" diameter 250 KSI stress relieved strands | |
| c. Cavities 16' | |
| i. Shape | |
| same as shown in FIG. 2 | |
| ii. Size | |
| same as disclosed before with reference to FIG. 2 | |
| iii. Pitches | |
| transverse | 35 mm |
| longitudinal | 44 mm |
| iv. Density | |
| 600/m | |
| d. Designated strength | |
| more than 400 kg/cm$^2$ | |
| B. Cast-in-place concrete 26' | |
| a. Composition of concrete material | |
| Portland cement | 292 (kg/m$^3$) |
| Fine aggregate | 806 |
| Coarse aggregate | 1027 |
| Admixture | 0.31 |
| Water | 169 |
| b. Reinforcing steel bars 24' | |
| 10 mm steel rods arranged in a lattice form | |
| c. Designated strength | |
| 250 kg/cm$^2$ | |
| C. Composite floor structure (test piece 30') | |
| a. Size | |
| 495 × 5200 mm | |
| b. Height or thickness in FIG. 7 | |
| h: 180 (mm) | |
| $h_1$: 100 | |
| $h_2$: 80 | |
| $h_3$: 100 | |
| $h_4$: 35 | |
| $h_5$: 45 | |

The test pieces and two precast reinforced concrete slabs per se as controls were subjected to a load test to obtain results as shown in the following table.

TABLE

| | Test Pieces Composite Slab | | Test Pieces Precast Slab | |
|---|---|---|---|---|
| | 1 | 2 | 1 | 2 |
| Initial cracking | | | | |
| theoretical (kg) | 1244 | 1244 | 741 | 741 |
| test results (kg) | 1980 | 1980 | 880 | 900 |
| shearing stress at boundary surface (kg/cm$^2$) | 1.88 | 1.88 | — | — |
| Maximum loading | | | | |
| theoretical (kg) | 4010 | 4010 | 1493 | 1493 |
| test results (kg) | 4930 | 4880 | 1700 | 1650 |
| shearing stress at boundary surface (kg/cm$^2$) | 4.68 | 4.63 | — | — |

Figure 8:
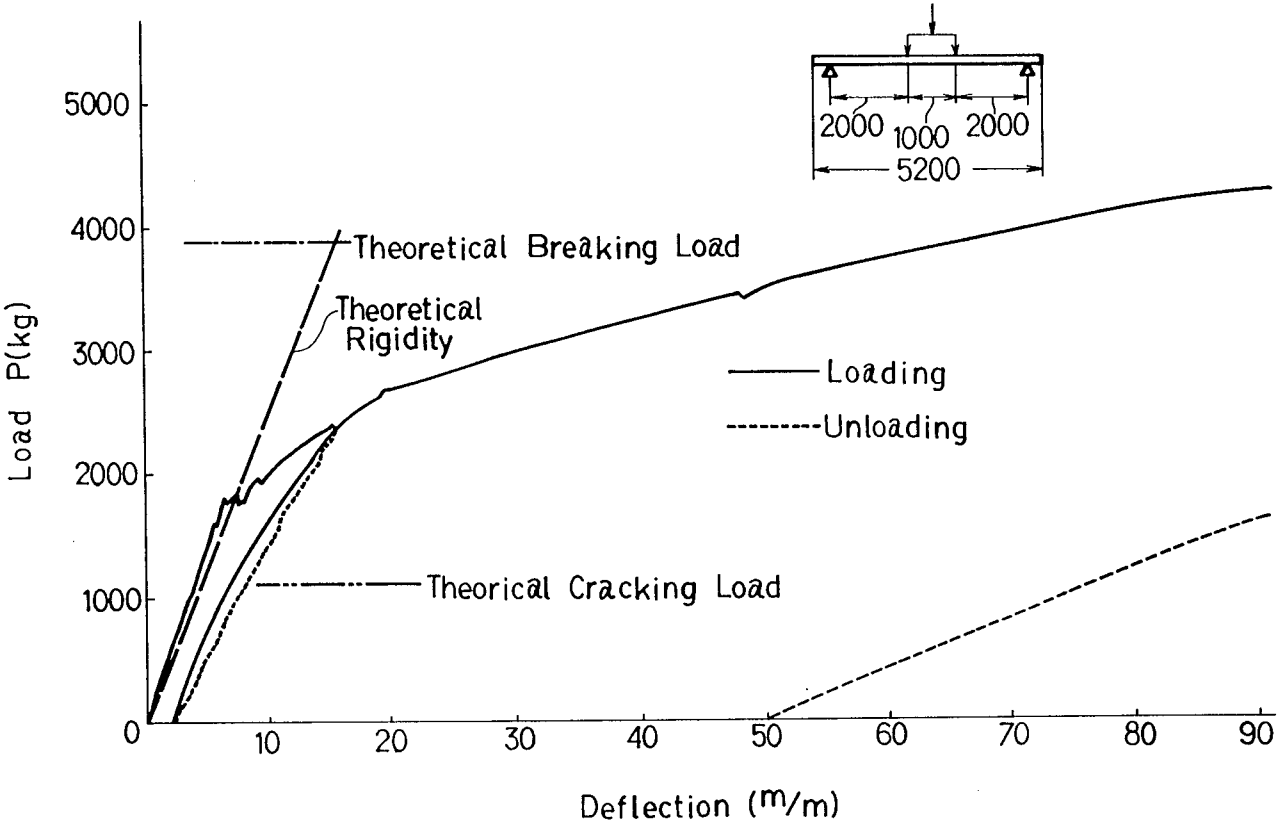
FIG. 8 is a graph showing results of deflection and rigidity tests performed on the test piece as shown in FIG. 7 and a precast concrete slab per se as shown in FIG. 1 as a control.

One of the test pieces (No. 1 composite slab— test piece) and one of the precast reinforced concrete slabs (No. 1 precast slab—test piece) were subjected to deflection and rigidity measuring tests, respectively, in the manner shown in FIG. 8 to obtain results as shown in a graph of FIG. 8.

Figure 9:
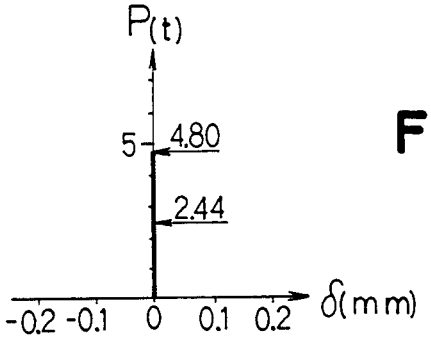
FIG. 9 is a graph showing the sliding factor at the boundary surface between a precast concrete slab and a cast-in-place concrete layer on the test piece shown in FIG. 7.

A sliding factor at the boundary surface between the precast concrete slab and the cast-in-place concrete layer on the No. 1 test piece was measured with the use of a displacement detector (sensitivity: $500\times10^{-6}$ mm) and an automatic recorder therefor. The result thereof is shown in FIG. 9. As seen from the figure, no slide or shear was recorded.

Figure 10:
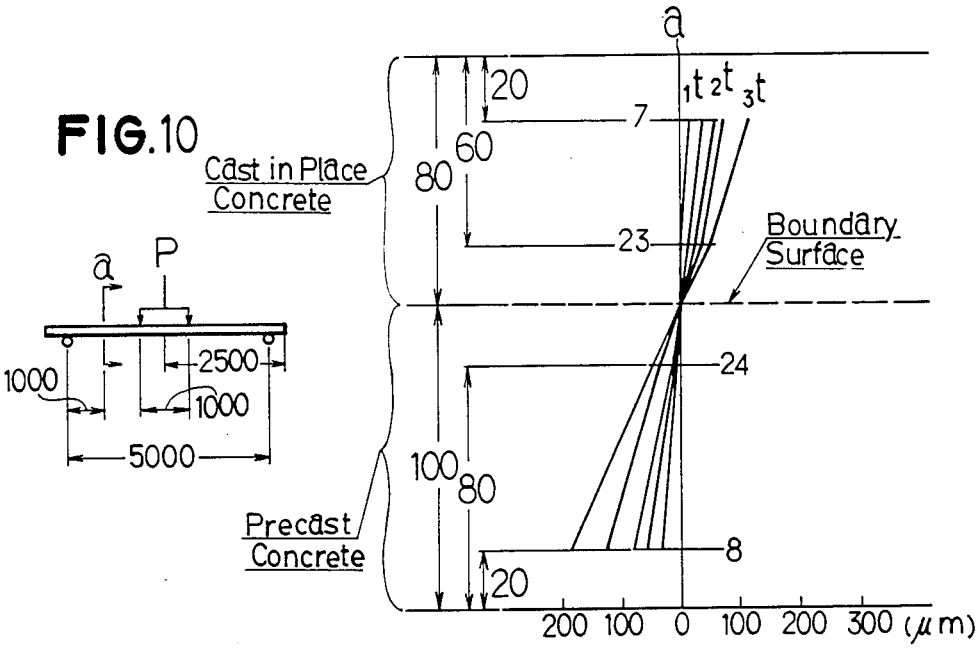
FIG. 10 is a graph showing the strain distribution in the vertical direction of the test piece shown in FIG. 7.

A strain distribution in the vertical direction in the No. 1 test piece was measured to obtain results as shown in FIG. 10. As seen from the figure, no saw-like distribution was recorded. This means that the precast slab and the cast-in-place concrete layer remained in an integral state.

I claim:

1. A multi-directional concrete floor comprising:

(a) a precast reinforced concrete slab having generally flat upper and lower surfaces, the upper surface defining a multiplicity of generally cylindrical cavities; and (b) a concrete layer superimposed only on the slab upper surface, the layer having a generally flat lower surface formed with a multiplicity of generally cylindrical shear members extending downwardly into interlocking contact with the slab cylindrical cavities, so that the shear members prevent relative movement between the slab and layer in all horizontal directions under bending forces.

2. A composite floor supported on building beams comprising:

(a) a plurality of precast reinforced concrete slabs having generally flat upper and lower surfaces and supported at the ends on the building beams, the slab ends being spaced from each other on the beams, the upper surfaces of each slab defining a multiplicity of generally cylindrical cavities;

(b) a plurality of anchors upstanding from the building beams in the spaces between the concrete slab ends;

(c) a plurality of reinforcing rods fastened to the anchors above the concrete slabs; and (d) a ready mixed concrete layer superimposed only on the concrete slabs upper surfaces and in the spaces between the concrete slabs to embed the reinforcing rods and anchors therein, the lower surfaces of the ready mixed layer being generally flat and having a multiplicity of generally cylindrical shear elements projecting downwardly therefrom into interlocking contact with the slab cavities, so that the shear elements interlocking with the concrete slabs prevent relative movement in all horizontal directions between the slabs and superimposed layers to thereby cause the floor to function as a multi-directional one piece composite floor.

3. A method of constructing a floor for buildings or similar structures comprising the steps of:

(a) placing on a building supporting structure a precast reinforced concrete slab having generally flat upper and lower surfaces and defining a multiplicity of generally cylindrical cavities in the upper surface thereof;

(b) arranging a plurality of non-parallel reinforcing steel bars above the concrete slab;

(c) pouring ready mixed concrete as a cast-in-place concrete layer only on the flat concrete slab upper surface to embed the reinforcing steel bars therein and to fill the concrete slab cylindrical cavities to thereby create multi-directional share members in interlocking connection with the respective cavities; and (d) curing the ready mixed concrete to form a multi-directional composite floor structure of the precast concrete slab and the cast-in-place concrete layer wherein relative horizontal movement between the flat mating surfaces of the slab and concrete layer in all horizontal directions due to vertical loads is prevented.

* * * * *